US010693247B2

(12) United States Patent
Chiyajo et al.

(10) Patent No.: US 10,693,247 B2
(45) Date of Patent: Jun. 23, 2020

(54) FIXATION STRUCTURE

(71) Applicant: Yazaki Corporation, Tokyo (JP)

(72) Inventors: Yuki Chiyajo, Shizuoka (JP); Hidehiko Shimizu, Shizuoka (JP); Haruhiko Yoshida, Shizuoka (JP); Keitaro Nozawa, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/445,767

(22) Filed: Jun. 19, 2019

(65) Prior Publication Data

US 2019/0393623 A1 Dec. 26, 2019

(30) Foreign Application Priority Data

Jun. 25, 2018 (JP) ..... 2018-119456

(51) Int. Cl.
*H01R 4/28* (2006.01)
*H01R 12/70* (2011.01)

(52) U.S. Cl.
CPC ..... *H01R 4/28* (2013.01); *H01R 12/70* (2013.01)

(58) Field of Classification Search
CPC ..... H01R 12/62; H01R 12/70; H01R 12/79; H01R 12/772; H01R 12/774; H01R 4/28
See application file for complete search history.

(56) References Cited

U.S. PATENT DOCUMENTS 3,629,787 A * 12/1971 Wilson ..... H01R 12/62 439/67
4,519,659 A * 5/1985 Shiino ..... H01R 13/2414 439/408
4,784,613 A * 11/1988 Deisch ..... H05K 3/308 439/405
4,808,112 A * 2/1989 Wood ..... H01R 12/613 439/66
4,918,277 A * 4/1990 Zimmer ..... B23K 3/0471 219/56.1
5,306,162 A * 4/1994 Armendariz ..... H01R 12/7082 439/493

(Continued)

FOREIGN PATENT DOCUMENTS

DE 20111338 U1 1/2003
EP 0073528 A2 3/1983

(Continued)

*Primary Examiner* — Oscar C Jimenez
(74) *Attorney, Agent, or Firm* — Sughrue Mion, PLLC

(57) ABSTRACT

A fixation structure includes an electrical wire, a board, and a stapler. The electrical wire includes a core wire and a cover member. The electrical wire includes a core-wire covered part covered by the cover member, and a core-wire exposed part exposed from the core-wire covered part. The board includes a junction part electrically connected with the core-wire exposed part. The stapler includes a contact part and a fixation part. The contact part has a plate shape, and is positioned at a boundary between the core-wire exposed part and the core-wire covered part while contacting the core-wire exposed part and the core-wire covered part from a side opposite to the board when the core-wire exposed part is connected with the junction part. A pair of the fixation parts are provided on both sides of the contact part and fix the contact part and the board.

5 Claims, 8 Drawing Sheets

(56) References Cited

U.S. PATENT DOCUMENTS

| | | | | |
|---|---|---|---|---|
| 5,752,851 | A | 5/1998 | Zaderej et al. | |
| 5,944,553 | A * | 8/1999 | Yasui | B60R 16/0215 439/492 |
| 5,947,764 | A | 9/1999 | Pan et al. | |
| 5,971,772 | A * | 10/1999 | Wang | H01R 12/88 439/67 |
| 7,976,328 | B2 * | 7/2011 | Tsai | H01R 23/661 439/341 |
| 2004/0018767 | A1 * | 1/2004 | Buck | H01R 12/598 439/329 |
| 2005/0130488 | A1 * | 6/2005 | Zhu | H01R 13/5804 439/470 |
| 2005/0245118 | A1 * | 11/2005 | Liu | H05K 3/361 439/329 |
| 2013/0344712 | A1 * | 12/2013 | Kole | H05K 3/363 439/67 |
| 2019/0329340 | A1 * | 10/2019 | Suzuki | H01F 17/0006 |

FOREIGN PATENT DOCUMENTS

| | | | |
|---|---|---|---|
| JP | 2015-220919 | A | 12/2015 |
| WO | 9729526 | A1 | 8/1997 |

* cited by examiner

FIXATION STRUCTURE

CROSS-REFERENCE TO RELATED APPLICATION(S)

The present application claims priority to and incorporates by reference the entire contents of Japanese Patent Application No. 2018-119456 filed in Japan on Jun. 25, 2018.

BACKGROUND OF THE INVENTION

1. Field of the Invention

The present invention relates to a fixation structure.

2. Description of the Related Art

Conventionally, for example, an electrical-wire fixation structure that fixes an electrical wire to a wiring plate has been disclosed by Japanese Patent Application Laid-open No. 2015-220919 as a fixation structure. This electrical-wire fixation structure includes a binding band, and an electrical-wire placement plate unit having a band plate shape, provided to a wiring plate, and sandwiched between a pair of cutout grooves. The electrical-wire fixation structure binds and fixes an electrical wire placed on the electrical-wire placement plate unit by using the binding band.

However, in the electrical-wire fixation structure disclosed in Japanese Patent Application Laid-open No. 2015-220919, the electrical-wire placement plate unit of the band plate needs to be formed by, for example, providing the pair of cutout grooves to the wiring plate. This configuration can be further improved.

SUMMARY OF THE INVENTION

The present invention is intended to solve the above-described problem, and it is an object of the present invention to provide a fixation structure that can appropriately fix an electrical wire to a board.

In order to solve the above mentioned problem and achieve the object, a fixation structure according to one aspect of the present invention includes an electrical wire including a core wire that is conductive and a cover member that covers the core wire, the electrical wire including a core-wire covered part covered by the cover member and a core-wire exposed part exposed from the core-wire covered part; a board including a junction part electrically connected with the core-wire exposed part; and a stapler including a contact part that has a plate shape and is positioned at a boundary between the core-wire exposed part and the core-wire covered part while contacting the core-wire exposed part and the core-wire covered part from a side opposite to the board when the core-wire exposed part is connected with the junction part, and a pair of fixation parts that are provided on both sides of the contact part and fix the contact part and the board.

According to another aspect of the present invention, in the fixation structure, it is preferable that the pair of fixation parts penetrate through the cover member of the core-wire covered part and are fixed to the board.

According to still another aspect of the present invention, in the fixation structure, it is preferable that the electrical wire is a flat cable including a plurality of the core wires arranged in an intersection direction intersecting an extension direction in which the core wires extend, and the stapler includes a stapler insulative part that is insulative, extends from the contact part to the core-wire exposed part side, and is positioned between the core wires adjacent to each other at the core-wire exposed part.

According to still another aspect of the present invention, in the fixation structure, it is preferable that the electrical wire is a flat cable including a plurality of the core wires arranged in an intersection direction intersecting an extension direction in which the core wires extend, and the stapler includes a core-wire positioning part extending from the contact part to the core-wire covered part side, penetrating through the cover member between the core wires adjacent to each other at the core-wire covered part, and having a leading end part positioned to the board.

According to still another aspect of the present invention, in the fixation structure, it is preferable that the fixation structure includes a housing to which the board is assembled, wherein the housing includes a housing unit that has a box shape with an opening and that houses the board, and a lid unit that is integrated with the stapler and blocks the opening, and the contact part of the stapler integrated with the lid unit contacts the core-wire exposed part and the core-wire covered part of the electrical wire connected with the board when the board is housed in the housing unit and the opening is blocked by the lid unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
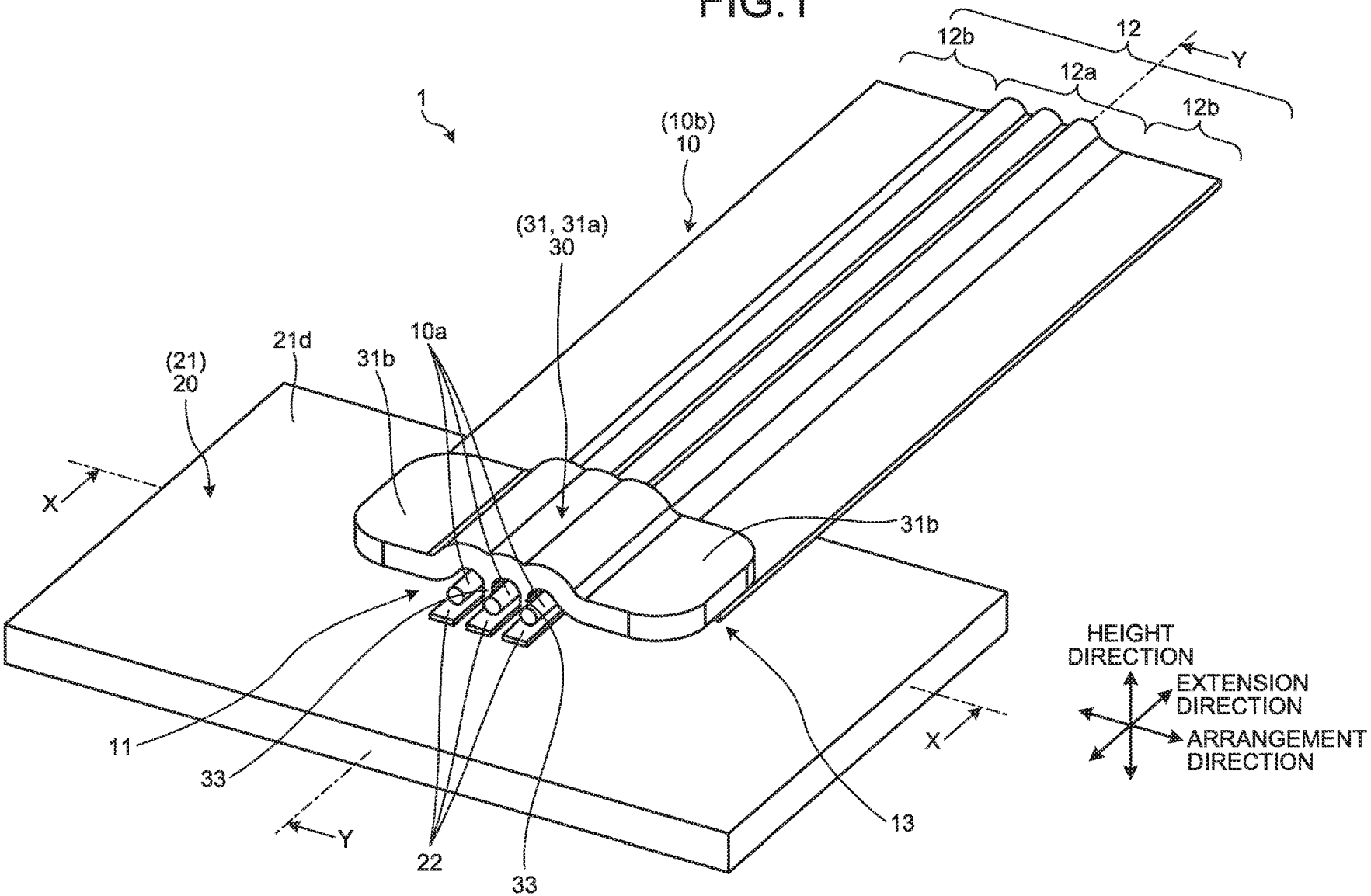
FIG. 1 is a perspective view illustrating an exemplary configuration of a fixation structure according to a first embodiment.
Figure 2:
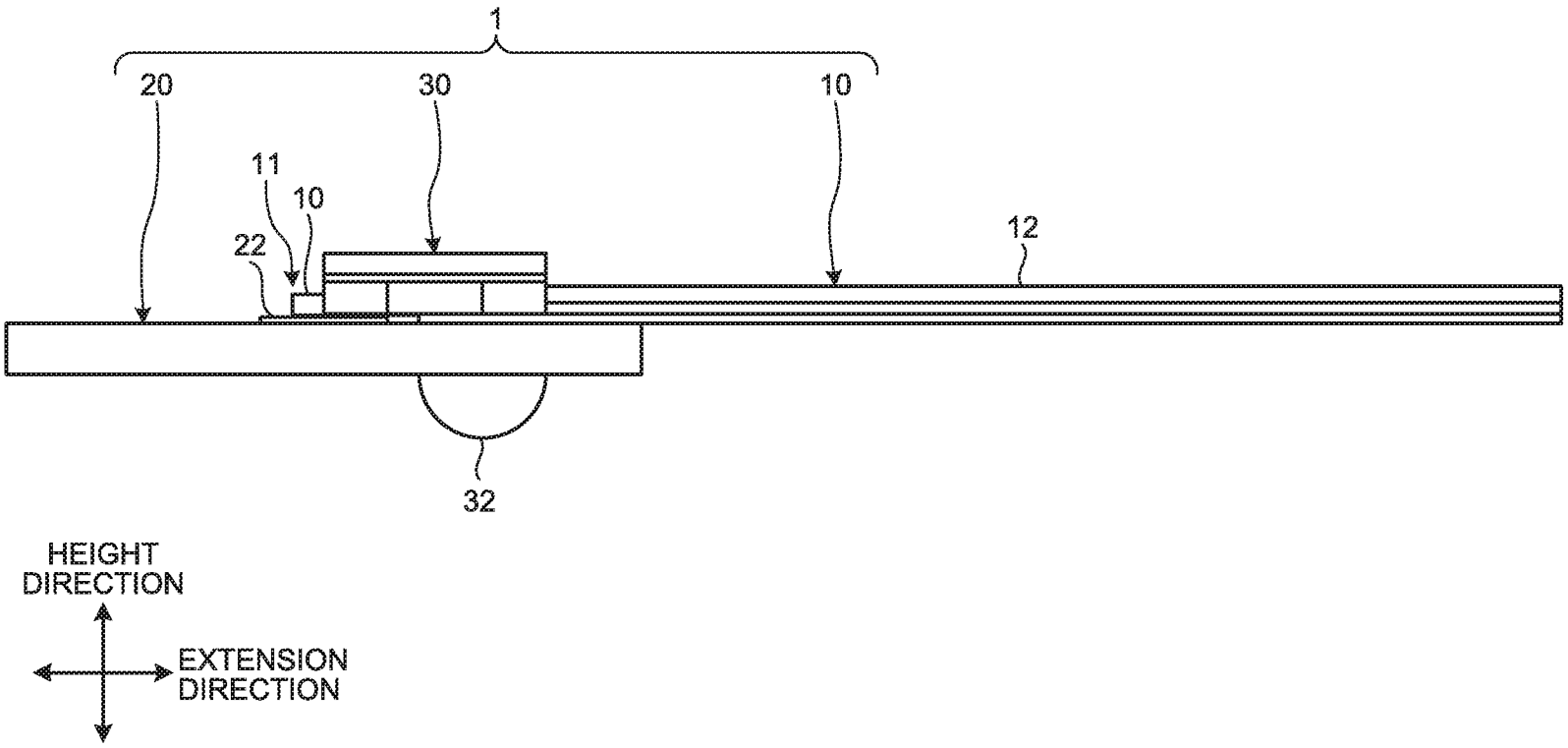
FIG. 2 is a side view illustrating the exemplary configuration of the fixation structure according to the first embodiment.
Figure 3:
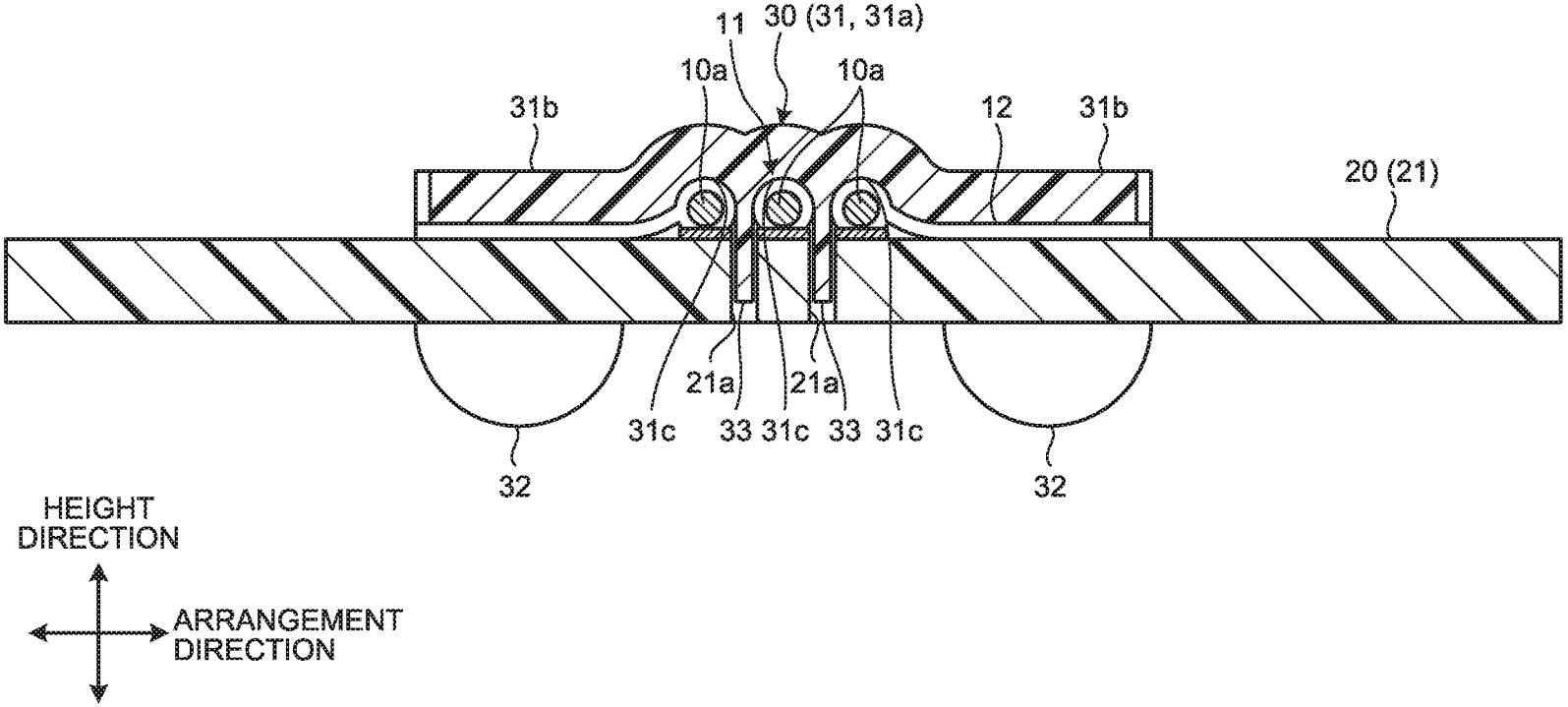
FIG. 3 is a cross-sectional view taken along line X-X in FIG. 1.

Modes (embodiments) for carrying out the present invention will be described below in detail with reference to the accompanying drawings. The present invention is not limited by the contents of the following description of the embodiments. Components described below include those easily thought of the skilled person in the art and those identical in effect. Moreover, configurations described below may be combined as appropriate. In addition, the configurations may be provided with various kinds of omission, replacement, and change without departing from the scope of the present invention.

First Embodiment

The following describes a fixation structure 1 according to a first embodiment. The fixation structure 1 fixes an electrical wire 10 and board 20 while the electrical wire 10 is electrically connected with the board 20. The fixation structure 1 is employed, for example, when the electrical wire 10 for monitoring the voltage of a battery is connected with the board 20 in a battery module of a vehicle such as an electric vehicle, but is not limited thereto. As illustrated in FIGS. 1 to 4, the fixation structure 1 includes the electrical wire 10, the board 20, and a stapler 30. In the following description, an extension direction is defined to be a direction in which the electrical wire 10 extends. In addition, an arrangement direction is defined to be a direction that intersects (for example, is orthogonal to) the extension direction and in which core wires 10*a* of the electrical wire 10 are arranged. In addition, a height direction is defined to be a direction orthogonal to a mount surface 21*d* of the board 20. The extension direction, the arrangement direction, and the height direction are substantially orthogonal to each other.

The electrical wire 10 is formed as, for example, a flexible flat conductive member in a flattened shape. The electrical wire 10 is, for example, a flat cable (FC), a flexible flat cable (FFC), a flexible printed circuit board (FPC), or a printed circuit body such as a membrane wiring plate. In this example, the electrical wire 10 is a flexible flat cable.

The electrical wire 10 includes the core wires 10*a* that is conductive, and a cover member 10*b* that covers the core wires 10*a*. In this example, the three core wires 10*a* are provided. The core wires 10*a* are arranged in the intersection direction (arrangement direction) intersecting the extension direction in which the core wire 10*a* extends. The cover member 10*b* covers part of each of the core wires 10*a* arranged in the arrangement direction. The electrical wire 10 includes a core-wire exposed part 11 and a core-wire covered part 12. The core-wire exposed part 11 is exposed from the core-wire covered part 12 and provided on a leading end side in the extension direction of the core wires 10*a*. The core-wire exposed part 11 is electrically connected with each junction part 22 of the board 20 to be described later by, for example, soldering or ultrasonic wave connection.

The core-wire covered part 12 is covered by the cover member 10*b*. The core-wire covered part 12 includes a body part 12*a*, an edge part 12*b*, a first covered through-hole 12*c* (refer to FIG. 4), and a second covered through-hole (not illustrated). The body part 12*a* covers the core wires 10*a* and has an irregular shape in accordance with the thickness (wire diameter) of each core wire 10*a*. The edge parts 12*b* are provided on both sides of the body part 12*a* in the arrangement direction and have flat shapes. The first covered through-hole 12*c* is a through-hole in which a core-wire positioning part 34 of the stapler 30 to be described later is inserted. The first covered through-hole 12*c* is provided the body part 12*a* of the core-wire covered part 12. For example, the first covered through-holes 12*c* are provided at two places of the body part 12*a* of the core-wire covered part 12, and each positioned between the core wires 10*a* in the arrangement direction. The second covered through-hole is a through-hole into which a fixation part 32 of the stapler 30 to be described later is inserted. The second covered through-hole is provided at each edge part 12*b* of the core-wire covered part 12. The second covered through-holes are provided at two places of the edge parts 12*b* of the core-wire covered part 12, and specifically, provided at the edge part 12*b* on one side and the edge part 12*b* on the other side, respectively, in the arrangement direction.

The board 20 is what is called a printed circuit board providing an electronic circuit on which various kinds of electronic components are mounted and that electrically connects these electronic components. In the board 20, a wiring pattern is formed (printed) on an insulating layer made of an insulative material such as epoxy resin, glass epoxy resin, paper epoxy resin, or ceramic by using a conductive member such as copper foil. The board 20 includes, for example, a base material 21 as the insulating layer, and the junction part 22 as the wiring pattern.

Figure 4:
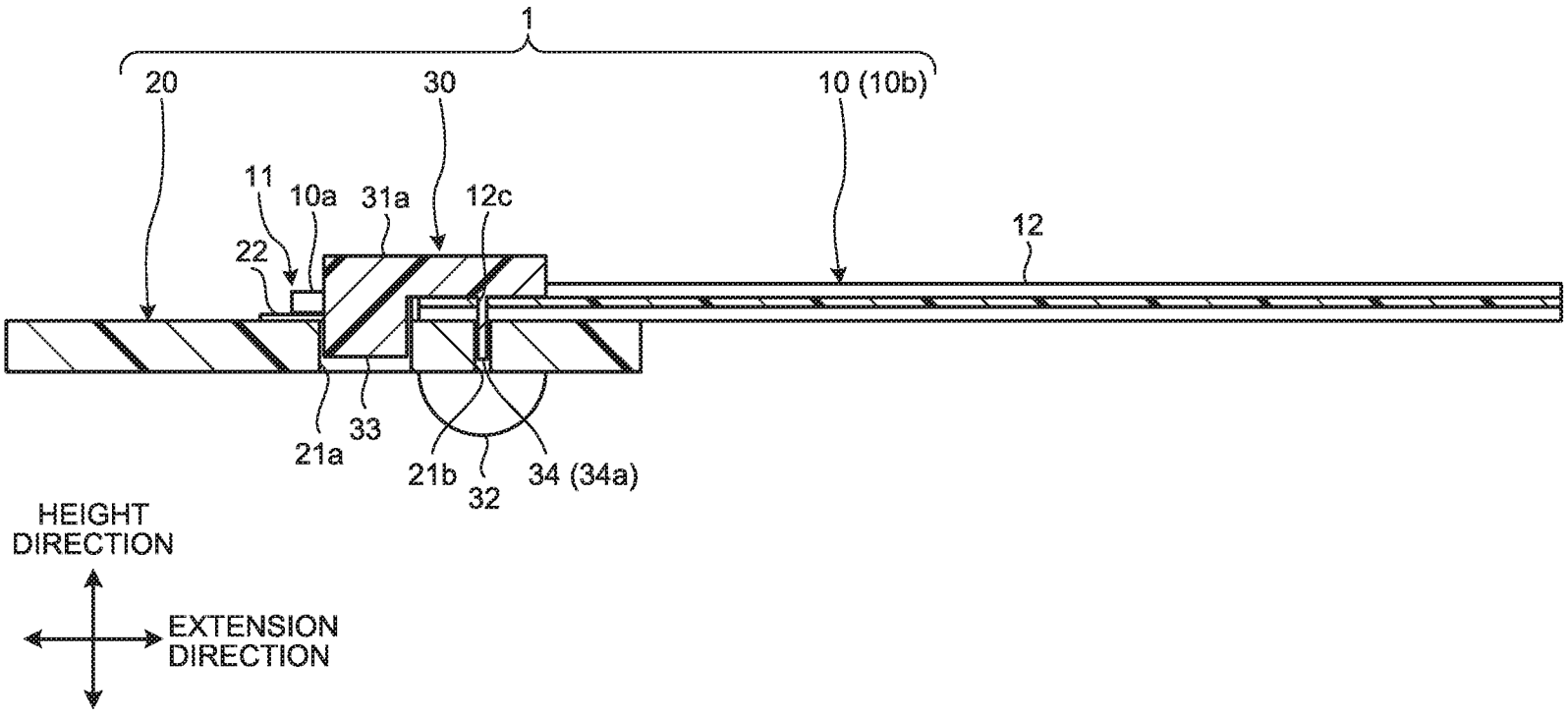
FIG. 4 is a cross-sectional view taken along line Y-Y in FIG. 1.

As illustrated in FIG. 4, the base material 21 includes a first base material through-hole 21*a*, a second base material through-hole 21*b*, and a third base material through-hole (not illustrated). The first base material through-hole 21*a* is a through-hole into which a stapler insulative part 33 of the stapler 30 to be described later is inserted (refer to FIGS. 3 and 4). The first base material through-hole 21*a* has a rectangular shape when viewed in the height direction and penetrates through the base material 21 in the height direction. The first base material through-holes 21*a* are provided at two places of the base material 21 and arranged in the arrangement direction. The stapler insulative part 33 of the stapler 30 is inserted into each first base material through-hole 21*a* from the mount surface 21*d* side in the height direction.

The second base material through-hole 21*b* is a through-hole into which the core-wire positioning part 34 of the stapler 30 to be described later is inserted (refer to FIG. 4). The second base material through-hole 21*b* has a circle shape when viewed in the height direction and penetrates through the base material 21 in the height direction. The second base material through-holes 21*b* are provided at two places of the base material 21 and arranged in the arrangement direction. The core-wire positioning part 34 of the stapler 30 is inserted into each second base material through-hole 21*b* from the mount surface 21*d* side in the height direction.

The third base material through-hole is a through-hole into which the fixation part 32 of the stapler 30 to be described later is inserted. The third base material through-hole has a circle shape when viewed in the height direction and penetrates through the base material 21 in the height direction. The third base material through-holes are provided at two places of the base material 21 and arranged in the arrangement direction. The fixation part 32 of the stapler 30 is inserted into each third base material through-hole from the mount surface 21*d* side in the height direction.

Each junction part 22 is electrically connected with the electrical wire 10 and formed on the mount surface 21*d* of the base material 21. The junction part 22 is made of a conductive member such as copper foil and has a linear shape in the extension direction. A plurality (for example, three) of the junction parts 22 are arranged in the arrangement direction. The junction part 22 is electrically connected with the corresponding core-wire exposed part 11 of the electrical wire 10 by, for example, soldering or ultrasonic wave connection.

The stapler 30 fixes the electrical wire 10 to the board 20. The stapler 30 includes a stapler body 31, a pair of the fixation parts 32, the stapler insulative part 33 (refer to, for example, FIGS. 1 and 3), and the core-wire positioning part 34 (refer to FIG. 4). The stapler body 31 is made of an insulative material such as resin and has a rectangular plate shape with round corners when viewed in the height direction. The length of the stapler body 31 in a width direction (the arrangement direction) is equal to the length of the electrical wire 10 in the width direction (arrangement direction). The stapler body 31 includes a contact part 31*a* and a flat part 31*b*.

The contact part 31*a* contacts the electrical wire 10. For example, the contact part 31*a* contacts the core-wire exposed part 11 and the core-wire covered part 12 from a side opposite to the board 20. The contact part 31*a* is provided at a central part of the stapler body 31 in the width direction. The contact part 31*a* is positioned at a boundary 13 between the core-wire exposed part 11 and the core-wire covered part 12 when the core-wire exposed part 11 is connected with the junction parts 22. The contact part 31*a* includes a plurality (in this example, three) of recesses 31*c*. The recesses 31*c* are each recessed in the extension direction and arranged in the arrangement direction. Each recess 31*c* has an arc shape along the profile of the corresponding core wire 10*a*. The recesses 31*c* contact the core-wire exposed part 11 and the core-wire covered part 12 from the side opposite to the board 20. Specifically, the recesses 31*c* contact part of the core-wire exposed part 11 and part of the body part 12*a* of the core-wire covered part 12. More specifically, the recesses 31*c* contact part of the core-wire exposed part 11 on the core-wire covered part 12 side in the extension direction and part of the body part 12*a* of the core-wire covered part 12 on the core-wire exposed part 11 side in the extension direction from the side opposite to the board 20. The contact part 31*a* prevents deformation of the core-wire exposed part 11 when the recesses 31*c* contact the core-wire exposed part 11 and the core-wire covered part 12.

The flat parts 31*b* extend from both sides of the contact part 31*a* in the arrangement direction. The flat parts 31*b* have flat shapes. The flat parts 31*b* contact the edge parts 12*b* of the core-wire covered part 12. For example, the flat parts 31*b* contact parts of the edge parts 12*b* of the core-wire covered part 12 on the core-wire exposed part 11 side. The flat parts 31*b* are provided with the pair of fixation parts 32, respectively, on the board 20 side in the height direction.

The pair of fixation parts 32 fix the stapler body 31 to the board 20. The pair of fixation parts 32 are bar members protruding on the board 20 side in the height direction from the flat parts 31*b*. The pair of fixation parts 32 are provided on both sides of the contact part 31*a*. For example, the pair of fixation parts 32 are provided for the respective flat parts 31*b* of the stapler body 31 on the board 20 side thereof. The pair of fixation parts 32 penetrate through the cover member 10*b* of the core-wire covered part 12 and are fixed to the board 20. In this example, the pair of fixation parts 32 are fixed to the cover member 10*b* of the core-wire covered part 12 and the board 20 while penetrating therethrough.

For example, the pair of fixation parts 32 are inserted and fixed to the second covered through-hole of the core-wire covered part 12 and the third base material through-holes of the board 20 while the core-wire exposed part 11 is positioned to the junction parts 22. In this case, when the pair of fixation parts 32 are inserted into the second covered through-hole of the core-wire covered part 12 and the third base material through-holes of the board 20, their end parts opposite to the stapler body 31 protrude from the board 20, and are then subjected to melting. These melted parts are formed to be larger than the third base material through-holes of the board 20 to prevent the pair of fixation parts 32 from dropping off.

The stapler insulative parts 33 insulate the core wires 10*a* of the core-wire exposed part 11. The stapler insulative parts 33 are made of, for example, insulative resin. Each stapler insulative part 33 is a plate member extending in the height direction from the board 20 side to the core-wire exposed part 11 side at the contact part 31*a* (refer to FIG. 4). The stapler insulative parts 33 are provided on the board 20 side and the core-wire exposed part 11 side at the contact part 31*a* of the stapler body 31. The stapler insulative parts 33 are arranged in the arrangement direction and each positioned between the adjacent core wires 10*a* of the core-wire exposed part 11. Thus, each stapler insulative part 33 is provided between the adjacent core wires 10*a* of the core-wire exposed part 11. When the core wires 10*a* of the core-wire exposed part 11 are positioned to the junction parts 22, the stapler insulative parts 33 are each inserted between the adjacent core wires 10*a* of the core-wire exposed part 11 and have leading ends inserted into the first base material through-holes 21*a* of the board 20. When the leading ends are inserted into the first base material through-holes 21*a* of the board 20, the stapler insulative parts 33 can prevent positional shift of the stapler insulative parts 33 and appropriately fix the position of the stapler insulative parts 33. The stapler insulative parts 33 can contribute to increase of the creepage distance between the adjacent core wires 10*a* of the core-wire exposed part 11.

The core-wire positioning parts 34 position the core wires 10*a* of the core-wire exposed part 11. The core-wire positioning parts 34 are made of, for example, insulative resin. The core-wire positioning parts 34 are bar members extending in the height direction from the board 20 side to the core-wire covered part 12 side at the contact part 31*a*. The core-wire positioning parts 34 are provided on the board 20 side and the core-wire covered part 12 side at the contact part 31*a* of the stapler body 31. The core-wire positioning parts 34 are arranged in the arrangement direction and each positioned between the adjacent core wires 10*a* at the core-wire covered part 12. Thus, each core-wire positioning part 34 is provided between the adjacent core wires 10*a* at the core-wire covered part 12. The core-wire positioning parts 34 each penetrate through the cover member 10*b* between the adjacent core wires 10*a* at the core-wire covered part 12, and have leading end parts 34*a* inserted into the second base material through-holes 21*b* of the board 20. The leading end parts 34*a* of the core-wire positioning parts 34 are inserted into the second base material through-holes 21*b* and positioned to the positions of the second base material through-holes 21*b*.

As described above, the fixation structure 1 according to the first embodiment includes the electrical wire 10, the board 20, and the stapler 30. The electrical wire 10 includes the core wires 10*a* that is conductive, and the cover member 10*b* that covers the core wires 10*a*. The electrical wire 10 includes the core-wire covered part 12 covered by the cover member 10*b*, and the core-wire exposed part 11 exposed from the core-wire covered part 12. The board 20 includes the junction parts 22 electrically connected with the core-wire exposed part 11. The stapler 30 includes the contact part 31*a* and the fixation parts 32. The contact part 31*a* has a plate shape, and is positioned at the boundary 13 between the core-wire exposed part 11 and the core-wire covered part 12 while contacting the core-wire exposed part 11 and the core-wire covered part 12 from the side opposite to the board 20 when the core-wire exposed part 11 is connected with the junction parts 22. The pair of fixation parts 32 are provided on both sides of the contact part 31*a* to fix the contact part 31*a* and the board 20.

In the fixation structure 1 with this configuration, since the contact part 31*a* of the stapler 30 contacts the core-wire exposed part 11 and the core-wire covered part 12, the core-wire exposed part 11 and the core-wire covered part 12 can be both pressed against the board 20. Accordingly, in the fixation structure 1, deformation, peeling, and the like of the core wires 10*a* of the core-wire exposed part 11 can be reduced as compared to, for example, a configuration in which the contact part 31*a* only contacts the core-wire covered part 12. Thus, the fixation structure 1 can excellently maintain connection between the core wires 10*a* of the core-wire exposed part 11 and the junction part 22. In the fixation structure 1, since the electrical wire 10 is fixed to the board 20 by the stapler 30, fixation work can be relatively easily performed. Accordingly, the fixation structure 1 leads to reduction of variance in the accuracy of work and reduction of manufacturing man-hour. As a result, the fixation structure 1 can appropriately fix the electrical wire 10 to the board 20.

In the above-described fixation structure 1, the pair of fixation parts 32 penetrate through the cover member 10*b* of the core-wire covered part 12 and are fixed to the board 20. In the fixation structure 1 with this configuration, the electrical wire 10 can be prevented from shifting in a plane direction of the board 20, in other words, the extension direction and the arrangement direction.

In the above-described fixation structure 1, the electrical wire 10 is a flat cable including the plurality of core wires 10*a* arranged in the intersection direction intersecting the extension direction in which the core wires 10*a* extend. The stapler 30 includes the stapler insulative parts 33 that are insulative, extend from the contact part 31*a* to the core-wire exposed part 11 side, and are positioned between the adjacent core wires 10*a* at the core-wire exposed part 11. In the fixation structure 1 with this configuration, the adjacent core wires 10*a* of the core-wire exposed part 11 are insulated from each other, thereby improving insulation of the core-wire exposed part 11. Accordingly, the fixation structure 1 can prevent short-circuit between the core wires 10*a* of the core-wire exposed part 11 and prevent decrease of the detection accuracy of a battery or the like.

In the above-described fixation structure 1, the stapler 30 includes the core-wire positioning parts 34 extending from the contact part 31*a* to the core-wire covered part 12 side, penetrating through the cover member 10*b* between the adjacent core wires 10*a* at the core-wire covered part 12, and having the leading end parts 34*a* positioned to the board 20. In the fixation structure 1 with this configuration, the core-wire positioning parts 34 can prevent the electrical wire 10 from shifting in the plane direction of the board 20, in other words, the extension direction and the arrangement direction. Accordingly, in the fixation structure 1, the core-wire exposed part 11 can be prevented from peeling off the junction part 22. Thus, the fixation structure 1 can prevent contact failure and prevent decrease of the detection accuracy of a battery or the like.

Second Embodiment

Figure 5:
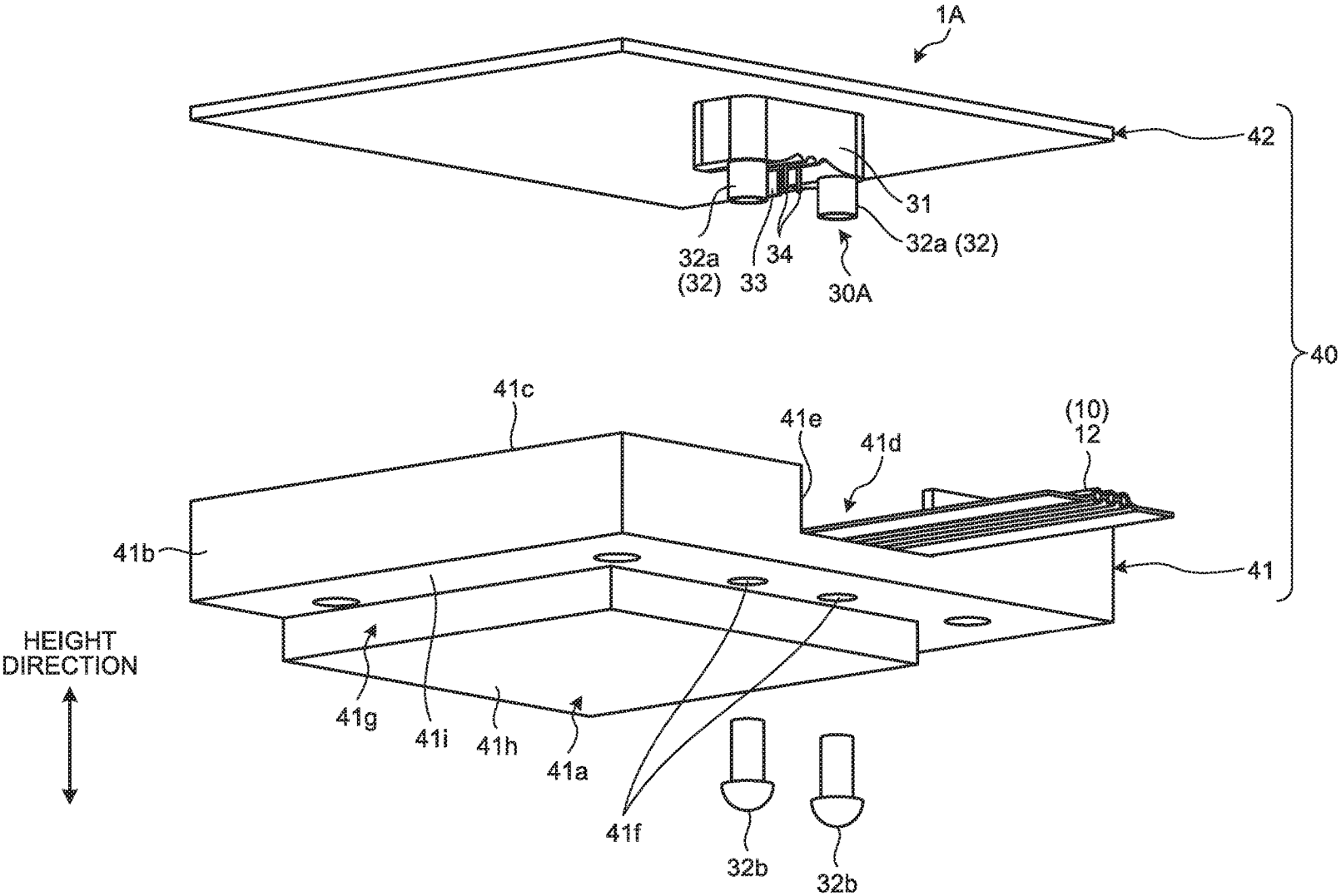
FIG. 5 is an exploded perspective view illustrating an exemplary configuration of a fixation structure according to a second embodiment.
Figure 6:
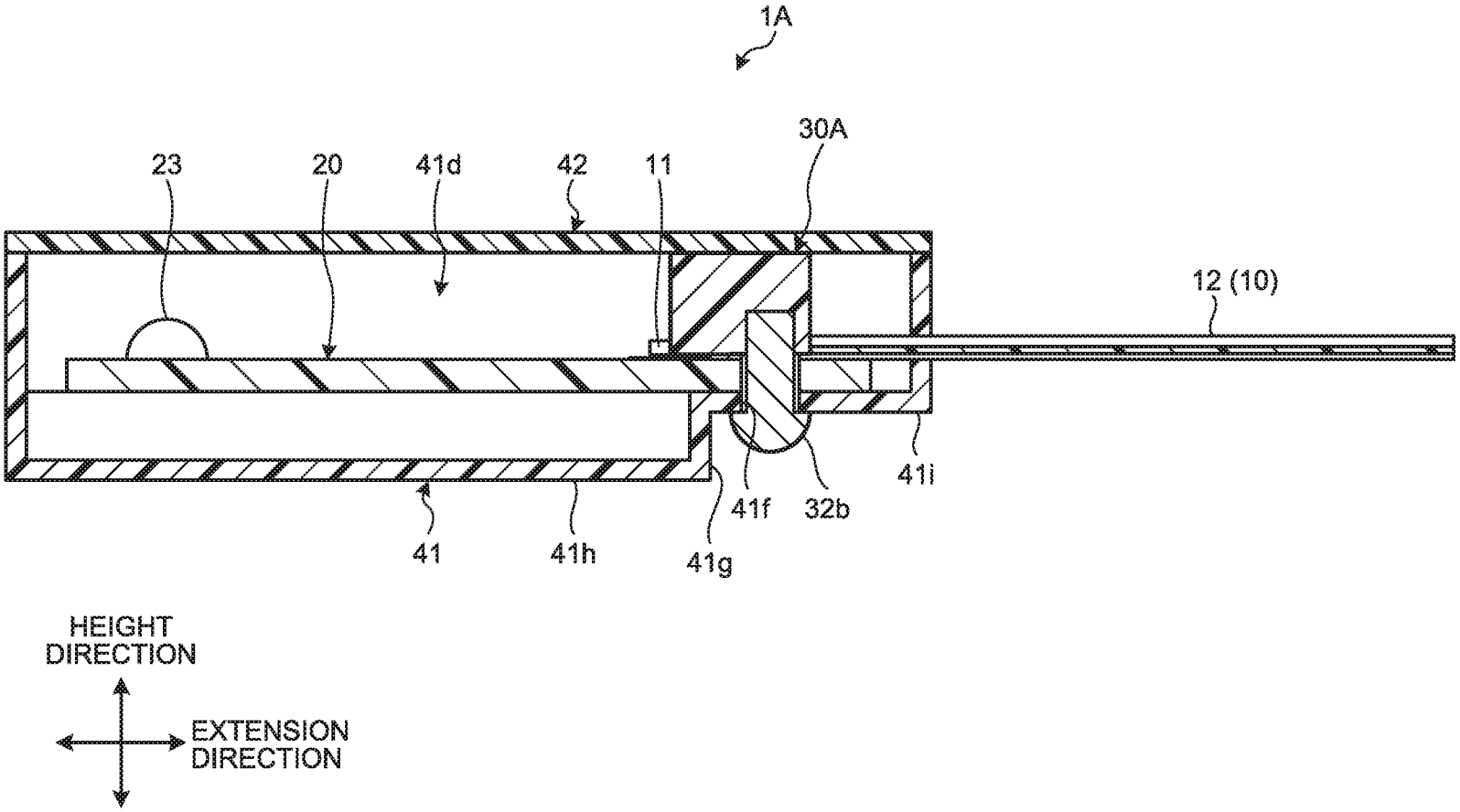
FIG. 6 is a cross-sectional view illustrating the exemplary configuration of the fixation structure according to the second embodiment.

The following describes a fixation structure 1A according to a second embodiment with reference to FIGS. 5 and 6. The fixation structure 1A according to the second embodiment is different from the fixation structure 1 according to the first embodiment in that a stapler 30A is integrated with a lid unit 42 of a housing 40. In the second embodiment, any component equivalent to that of the first embodiment is denoted by the same reference sign, and detailed description thereof will be omitted. The fixation structure 1A includes the electrical wire 10, the board 20, the stapler 30A, and the housing 40. The housing 40 is a housing to which the board 20 and the like are assembled, and includes a housing unit 41, and the lid unit 42. The housing unit 41 is a lower case made of, for example, insulative resin and having a box shape. The housing unit 41 has a bottom surface 41*a*, a side surface 41*b*, and an opening 41*c*.

The bottom surface 41*a* has a rectangular shape and is provided on a side opposite to the opening 41*c* in the height direction. The bottom surface 41*a* includes a stepped part 41*g* having a step in the height direction. The stepped part 41*g* includes a first bottom surface 41*h* and a second bottom surface 41*i*. The first bottom surface 41*h* and the second bottom surface 41*i* have heights different from each other in the height direction. The second bottom surface 41*i* is formed at a shorter distance from the opening 41*c* in the height direction than the first bottom surface 41*h*. The second bottom surface 41*i* is provided with two through-holes 41*f* into which screws 32*b* are inserted.

The side surface 41*b* is erected from the bottom surface 41*a* in the height direction. The side surface 41*b* is erected from, for example, each edge part of the second bottom surface 41*i*. Part of the electrical wire 10 and the board 20 are housed in a housing space 41*d* surrounded by the side surfaces 41*b* and the bottom surface 41*a*. The side surface 41*b* includes a cutout part 41*e* as a partial cutout. The cutout part 41*e* is a part through which the electrical wire 10 connected with the board 20 housed in the housing space 41*d* extends out of the housing space 41*d*.

The housing unit 41 is opened at the opening 41*c*. The opening 41*c* has a rectangular shape and is provided on a side opposite to the bottom surface 41*a* in the height direction. The opening 41*c* is unblocked (opened) when the board 20 is housed in the housing space 41*d*. The opening 41*c* is blocked by the lid unit 42.

The lid unit 42 is an upper case that blocks the opening 41*c* of the housing unit 41. The lid unit 42 has a rectangular plate shape. The lid unit 42 is integrated with the stapler 30A. The lid unit 42 is provided with the stapler 30A on, for example, the board 20 side (back surface side) in the height direction. For example, a side of the stapler body 31 opposite to the fixation part 32 side is fixed to the lid unit 42.

The opening 41*c* of the housing 40 is blocked by the lid unit 42 while the board 20 housed in the housing space 41*d* is fixed to the second bottom surface 41*i* by a screw 23 (refer to FIG. 6). Then, the screws 32*b* are screwed into cylindrical parts 32*a* of the fixation parts 32 through the through-holes 41*f* of the second bottom surface 41*i* so that the stapler 30A is fixed to the board 20 in the housing 40. In this case, the contact part 31*a* of the stapler 30A integrated with the lid unit 42 contacts the core-wire exposed part 11 and the core-wire covered part 12 of the electrical wire 10 connected with the board 20. Heads of the screws 32*b* are positioned at the stepped part 41*g* between the first bottom surface 41*h* and the second bottom surface 41*i*, and do not protrude from the first bottom surface 41*h* as the lowermost surface of the housing 40. In the fixation structure 1A, since the stapler 30A is fixed to the board 20 by the screws 32*b*, constant fixation force can be achieved. In addition, in the fixation structure 1A, resin used for the stapler 30A are not limited unlike a case in which end parts of the resin fixation parts 32 are melted to achieve fixation.

As described above, the fixation structure 1A according to the second embodiment includes the housing 40 to which the board 20 is assembled. The housing 40 includes the housing unit 41 and the lid unit 42. The housing unit 41 has a box shape with the opening 41*c*, and houses the board 20. The lid unit 42 is integrated with the stapler 30A, and blocks the opening 41*c*. The contact part 31*a* of the stapler 30A integrated with the lid unit 42 contacts the core-wire exposed part 11 and the core-wire covered part 12 of the electrical wire 10 connected with the board 20 when the board 20 is housed in the housing unit 41 and the opening 41*c* is blocked by the lid unit 42.

In the fixation structure 1A with this configuration, the stapler 30A is pressed to the board 20 side by the lid unit 42 while the opening 41*c* is blocked by the lid unit 42. In the fixation structure 1A, for example, the entire stapler body 31 can be pressed to the board 20 side. Accordingly, in the fixation structure 1A, the electrical wire 10 can be solidly pressed to the board 20 by the stapler 30A pressed by the lid unit 42, thereby preventing positional shift of the electrical wire 10. In addition, in the fixation structure 1A, since the stapler 30A and the lid unit 42 are integrated, a member pressing the stapler 30A to the board 20 can be omitted to reduce the number of components. Through the reduction of the number of components, the fixation structure 1A can achieve improvement of assembly operability and reduction of manufacturing cost.

Modification of Second Embodiment

Figure 7:
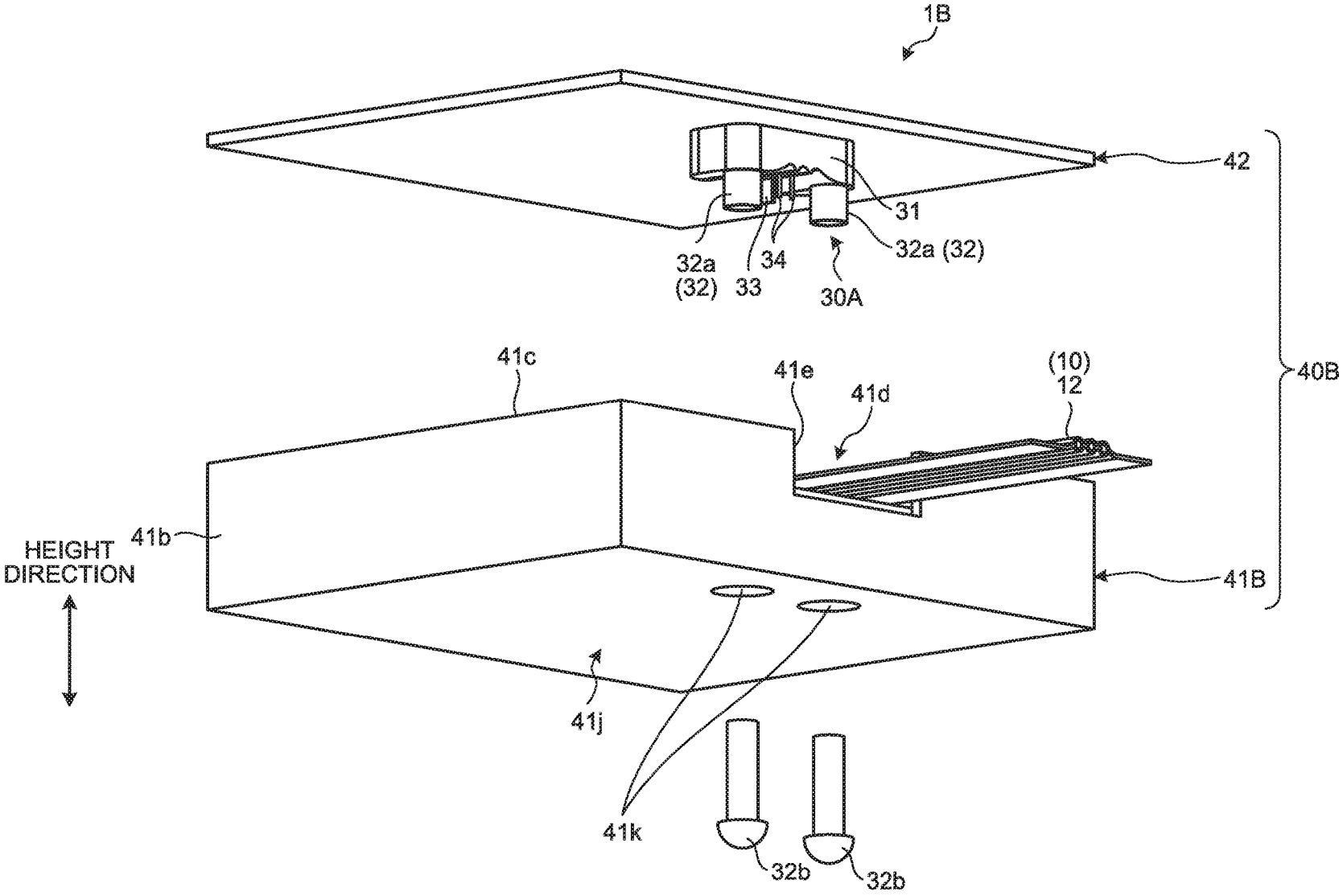
FIG. 7 is an exploded perspective view illustrating an exemplary configuration of a fixation structure according to a modification of the second embodiment.
Figure 8:
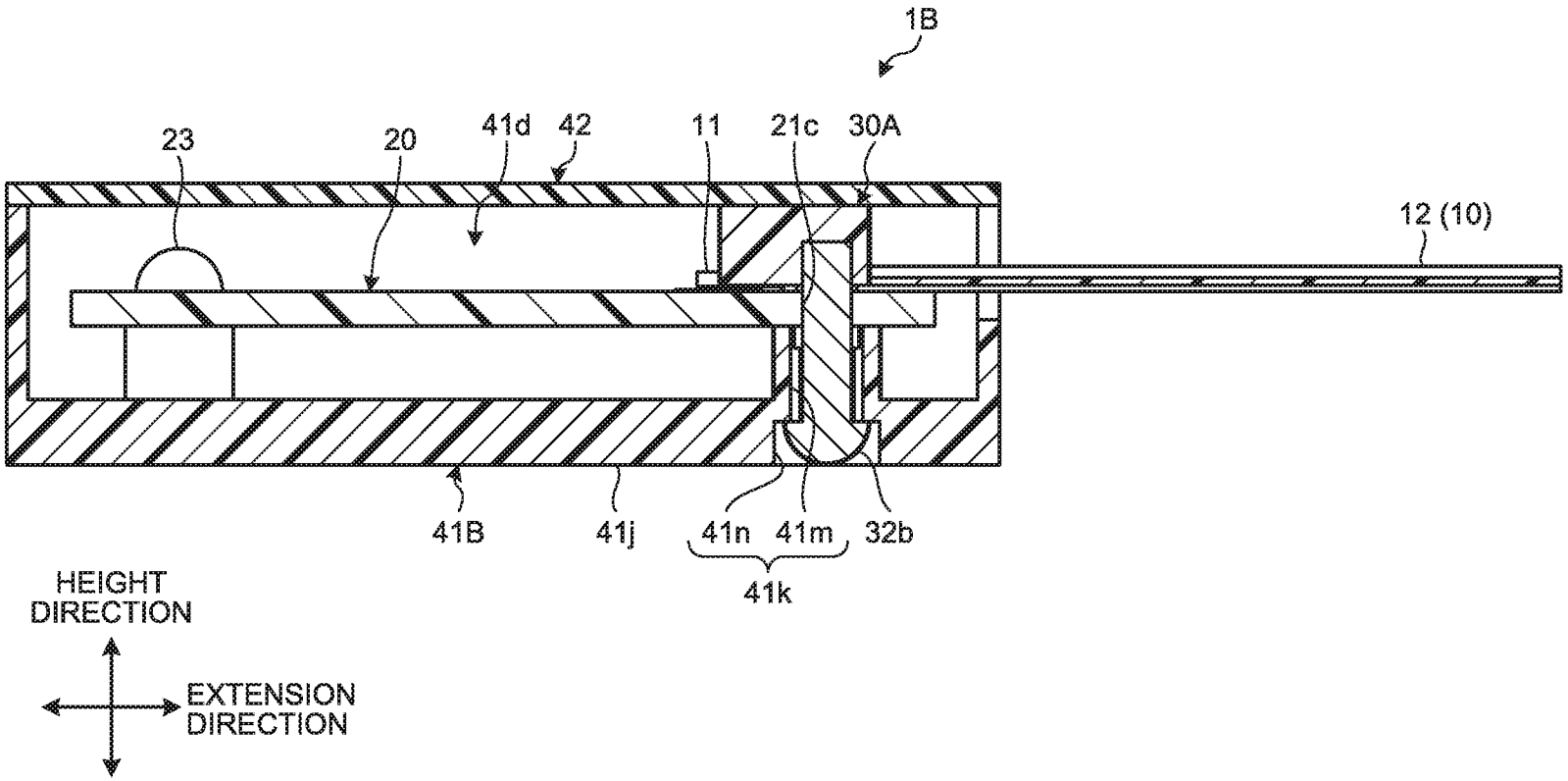
FIG. 8 is a cross-sectional view illustrating the exemplary configuration of the fixation structure according to the modification of the second embodiment.

The following describes a fixation structure 1B according to a modification of the second embodiment with reference to FIGS. 7 and 8. The fixation structure 1B according to the modification of the second embodiment is different from the fixation structure 1A according to the second embodiment in that the heads of each screw 32*b* is housed inside a through-hole 41*k* of a housing 40B. In the modification of the second embodiment, any component equivalent to that of the second embodiment is denoted by the same reference sign, and detailed description thereof will be omitted. The fixation structure 1B includes the electrical wire 10, the board 20, the stapler 30A, and the housing 40B. The housing 40B is a housing to which the board 20 and the like are assembled, and includes a housing unit 41B and the lid unit 42. The housing unit 41B is made of, for example, insulative resin and has a box shape. The housing unit 41B has a bottom surface 41*j*, the side surface 41*b*, and the opening 41*c*.

The bottom surface 41*j* has a rectangular shape and is provided on a side opposite to the opening 41*c* in the height direction. The bottom surface 41*j* has a flat shape and is provided with the two through-holes 41*k* into which the screws 32*b* are inserted. Each through-hole 41*k* includes a shank insertion part 41*m* into which a shank of the corresponding screw 32*b* is inserted, and a head housing part 41*n* that houses the head of the screw 32*b* (refer to FIG. 8).

The opening 41*c* of the housing 40B is blocked by the lid unit 42 while the board 20 is housed in the housing space 41*d* of the housing unit 41B and the board 20 housed in the housing space 41*d* is fixed to the bottom surface 41*j* by the screw 23. Then, the screws 32*b* are screwed into the cylindrical parts 32*a* of the fixation parts 32 through the through-holes 41*k* of the bottom surface 41*j* so that the stapler 30A is fixed to the board 20 in the housing 40B. In this case, the contact part 31*a* of the stapler 30A integrated with the lid unit 42 contacts the core-wire exposed part 11 and the core-wire covered part 12 of the electrical wire 10 connected with the board 20. The heads of the screws 32*b* are housed in the head housing part 41*n*, and do not protrude from the bottom surface 41*j* as the lowermost surface of the housing 40B. In the fixation structure 1B with this configuration, since the heads of the screws 32*b* do not protrude from the bottom surface 41*j*, installation easiness of the housing 40B is improved. In addition, in the fixation structure 1B, since the stapler 30A is fixed to the board 20 by the screws 32*b*, constant fixation force can be achieved. Moreover, in the fixation structure 1B, resin used for the stapler 30A is not limited unlike a case in which end parts of the resin fixation parts 32 are melted to achieve fixation.

The above description is made with the example in which the stapler body 31 is fixed to the board 20 by melting end parts of the fixation parts 32 opposite to the stapler body 31 and the example in which the stapler body 31 is fixed to the board 20 by the screws 32*b*, but the present invention is not limited thereto. For example, lock clicks (not illustrated) may be provided at the end parts of the fixation parts 32 opposite to the stapler body 31. Each lock click is an elastically deformable member that expands under application of no external force and contracts under application of external force. When removed out of the third base material through-holes of the board 20, the lock clicks expand and lock on the back surface of the board 20.

In the described example, the electrical wire 10 is a flat cable, but is not limited thereto and may be another cable.

In the described example, the pair of fixation parts 32 penetrate through the core-wire covered part 12, but are not limited thereto. The pair of fixation parts 32 may be fixed to the board 20 without penetrating through the core-wire covered part 12.

In the described example, the pair of fixation parts 32 penetrate through the board 20, but are not limited thereto. The pair of fixation parts 32 may be fixed to the board 20 without penetrating the board 20.

In the described example, the stapler insulative parts 33 are inserted into the first base material through-holes 21*a* of the board 20, but are not limited, and may be not inserted into the first base material through-holes 21*a* of the board 20.

In the described example, the stapler insulative parts 33 each have a plate shape, but are not limited thereto, but may have other shapes.

In the described example, the core-wire positioning parts 34 perform positioning when the leading end parts 34*a* are inserted into the second base material through-holes 21*b*, but are not limited thereto. The core-wire positioning parts 34 may perform positioning through, for example, engagement with grooves at which the leading end parts 34*a* do not penetrate through the board 20.

A fixation structure according to the present embodiment can appropriately fix an electrical wire to a board by a stapler including a contact part that contacts a core-wire exposed part and a core-wire covered part from a side opposite to the board.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixation structure comprising:

an electrical wire including a core wire that is conductive and a cover member that covers the core wire, the electrical wire including a core-wire covered part covered by the cover member and a core-wire exposed part exposed from the core-wire covered part;

a board including a junction part electrically connected with the core-wire exposed part; and a stapler including a contact part that has a plate shape and is positioned at a boundary between the core-wire exposed part and the core-wire covered part while contacting the core-wire exposed part and the core-wire covered part from a side opposite to the board when the core-wire exposed part is connected with the junction part, and a pair of fixation parts that are provided on both sides of the contact part and fix the contact part and the board, wherein the electrical wire is a flat cable including a plurality of the core wires arranged in an intersection direction intersecting an extension direction in which the core wires extend, the stapler includes a stapler insulative part that is insulative, extends from the contact part to the core-wire exposed part side, and is positioned between the core wires adjacent to each other at the core-wire exposed part, and the stapler includes a core-wire positioning part extending from the contact part to the core-wire covered part side, penetrating through the cover member between the core wires adjacent to each other at the core-wire covered part, and having a leading end part positioned to the board.

2. The fixation structure according to claim 1, wherein the pair of fixation parts penetrate through the cover member of the core-wire covered part and are fixed to the board.

3. The fixation structure according to claim 2, further comprising:

a housing to which the board is assembled, wherein the housing includes a housing unit that has a box shape with an opening and that houses the board, and a lid unit that is integrated with the stapler and blocks the opening, and the contact part of the stapler integrated with the lid unit contacts the core-wire exposed part and the core-wire covered part of the electrical wire connected with the board when the board is housed in the housing unit and the opening is blocked by the lid unit.

4. The fixation structure according to claim 1, further comprising:

a housing to which the board is assembled, wherein the housing includes a housing unit that has a box shape with an opening and that houses the board, and a lid unit that is integrated with the stapler and blocks the opening, and the contact part of the stapler integrated with the lid unit contacts the core-wire exposed part and the core-wire covered part of the electrical wire connected with the board when the board is housed in the housing unit and the opening is blocked by the lid unit.

5. A fixation structure comprising:

an electrical wire including a core wire that is conductive and a cover member that covers the core wire, the electrical wire including a core-wire covered part covered by the cover member and a core-wire exposed part exposed from the core-wire covered part;

a board including a junction part electrically connected with the core-wire exposed part;

a stapler including a contact part that has a plate shape and is positioned at a boundary between the core-wire exposed part and the core-wire covered part while contacting the core-wire exposed part and the core-wire covered part from a side opposite to the board when the core-wire exposed part is connected with the junction part, and a pair of fixation parts that are provided on both sides of the contact part and fix the contact part and the board; and a housing to which the board is assembled; wherein the housing includes a housing unit that has a box shape with an opening and that houses the board, and a lid unit that is integrated with the stapler and blocks the opening, and the contact part of the stapler integrated with the lid unit contacts the core-wire exposed part and the core-wire covered part of the electrical wire connected with the board when the board is housed in the housing unit and the opening is blocked by the lid unit.

* * * * *